US008506876B2

(12) United States Patent
Suzuki et al.

(10) Patent No.: US 8,506,876 B2
(45) Date of Patent: Aug. 13, 2013

(54) METHOD TO CONTROL AUTOMATIC POURING EQUIPMENT AND SYSTEM THEREFOR

(75) Inventors: Makio Suzuki, Toyokawa (JP); Yanyan Yang, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 95 days.

(21) Appl. No.: 12/934,050

(22) PCT Filed: Mar. 16, 2009

(86) PCT No.: PCT/JP2009/055561
§ 371 (c)(1),
(2), (4) Date: Sep. 22, 2010

(87) PCT Pub. No.: WO2009/119464
PCT Pub. Date: Oct. 1, 2009

(65) Prior Publication Data

US 2011/0017783 A1 Jan. 27, 2011

(30) Foreign Application Priority Data

Mar. 25, 2008 (JP) ..... 2008-076922
Dec. 17, 2008 (JP) ..... 2008-321217

(51) Int. Cl.
*B22D 41/06* (2006.01)

(52) U.S. Cl.
USPC ..... 266/45; 266/236

(58) Field of Classification Search
USPC ..... 266/45, 44, 236, 99, 96; 164/335
See application file for complete search history.

(56) References Cited

U.S. PATENT DOCUMENTS

| | | | | |
|---|---|---|---|---|
| 5,758,714 | A | 6/1998 | Sato et al. | |
| 6,619,371 | B1 | 9/2003 | Lauper | |
| 8,114,338 | B2 * | 2/2012 | Noda et al. | 266/44 |
| 8,127,824 | B2 * | 3/2012 | Terada et al. | 164/335 |

FOREIGN PATENT DOCUMENTS

| | | | |
|---|---|---|---|
| CN | 101244457 | A | 8/2008 |
| EP | 1 967 302 | A1 | 9/2008 |
| EP | 2 008 741 | A1 | 12/2008 |
| JP | 4-46665 | | 2/1992 |
| JP | 2005-88041 | | 4/2005 |
| WO | WO 2007/119697 | A1 | 10/2007 |

OTHER PUBLICATIONS

Chinese Office Action dated Nov. 28, 2012 issued in corresponding Chinese appln. 200980101976.7.

* cited by examiner

*Primary Examiner* — Scott Kastler
(74) *Attorney, Agent, or Firm* — Finnegan, Henderson, Farabow, Garrett & Dunner, L.L.P.

(57) ABSTRACT

The present invention provides a method to control automatic pouring equipment that can pour molten metal in a desired sequence, and it also provides the system therefor. The method to control the automatic pouring equipment comprises pouring the molten metal by three servomotors that are each driven and controlled by a PLC and that act to have the ladle tilted, hoisted, and move backward and forward, characterized in that the method comprises pouring the molten metal into the mold from the ladle by a continuous driving of the servomotors by the instructions given by the PLC, at the same time measuring the weight of the automatic pouring equipment, including the weight of the three servomotors by a means to measure the weight, and calculating the change of the weight of the molten metal in the ladle by the PLC, and in that the method comprises pouring the molten metal, disregarding the results of measurements obtained by the means to measure the weight of the automatic pouring equipment, including the weight of the three servomotors, when an acceleration force works on the ladle.

6 Claims, 6 Drawing Sheets

METHOD TO CONTROL AUTOMATIC POURING EQUIPMENT AND SYSTEM THEREFOR

TECHNICAL FIELD

The present invention is directed to a method to control automatic pouring equipment and a system therefor. More particularly, it is directed to the method to control automatic pouring equipment wherein the operation to pour molten metal is performed in sequence by three servomotors that are driven under PLC control and wherein the servomotors act to have the ladle tilted, lifted, and moved backward and forward relative to a mold. The present invention is also directed to the system therefor.

TECHNOLOGICAL BACKGROUND

In the present technical field, one type of typical conventional automatic pouring equipment that pours molten metal by tilting a ladle is one that comprises:

a driving means that tilts a ladle;

a means to detect the weight of the ladle section, including the ladle and the molten metal in the ladle; and a means to control by the driving means the angle of the tilting of the ladle, firstly by calculating the flow rate of the metal based on data obtained from the means to detect the weight and then by controlling the flow rate to have it reach a predetermined value, wherein the pouring of metal can be carried out so that it corresponds to the rate of molding that is predetermined on the side of the mold, by maintaining the pouring rate of the molten metal at the predetermined value and without use of any special ladle (Publication of Laid-open Japanese Patent Application, No. H04-46665).

DISCLOSURE OF THE INVENTION

An experiment of a control drive of the driving means was carried out using the above-described automatic pouring equipment to see if by controlling it by a microcomputer that has a program preinstalled, which program controls the operation of pouring, pouring molten metal into a mold from the ladle can be performed in a desired sequence.

However, with the conventional automatic pouring equipment as described above, there were problems in that 1) the means to detect the weight of the total weight of the ladle section, including the weight of the molten metal in the ladle, could not measure the precise quantity of the molten metal that was poured because of the additional force that was due to the accelerated speed that the ladle gained, if the ladle were moved with an accelerated speed, and in that 2) then the conventional automatic pouring equipment could not pour in a desired sequence. This is because the additional force would work on the means to detect the weight of the ladle section, including the ladle and the molten metal in the ladle.

With a view to resolving the above problems, the present invention aims to provide a method to control automatic pouring equipment and a system therefor, wherein the automatic pouring equipment pours the molten metal into the mold in a desired sequence.

To achieve the above-described objective, the method to control the automatic pouring equipment, of the present invention, comprises pouring the molten metal by three servomotors that are each driven and controlled by a PLC and that act to have the ladle tilted, lifted, and moved backward and forward relative to the mold, characterized in that the method comprises pouring the molten metal into the mold from the ladle by a continuous driving of the servomotors by instructions given by the PLC, at the same time measuring the weight of the automatic pouring equipment, including the weight of the three servomotors, by a means to measure weight, and calculating the change of the weight of molten metal in the ladle by the PLC, and in that the method comprises pouring the molten metal, disregarding the results of measurements obtained by the means to measure the weight of the automatic pouring equipment, including the weight of the three servomotors, when an acceleration force works on the ladle.

Further, to achieve the above-described objective, the method to control the automatic pouring equipment, of the present invention, comprises driving each of the three servomotors under PLC control, having the ladle tilted, by a first tilting and a second tilting, and moved backward and forward relative to the mold, and pouring the molten metal in sequence, characterized in that the method comprises pouring the molten metal into the mold from the ladle by a continuous driving of the servomotors by the instructions given by the PLC, at the same time measuring the weight of the automatic pouring equipment, including the weight of the three servomotors by a means to measure weight, and calculating the change of the weight of the molten metal in the ladle by the PLC, and in that the method comprises pouring the molten metal, disregarding the results of measurements obtained by the means to measure the weight of the automatic pouring equipment, including the weight of the three servomotors, when an acceleration force works on the ladle.

Effects of the Invention

Thus, the method to control the automatic pouring equipment of the present invention has excellent practical effects, such as the effect whereby it can pour the molten metal into the mold in a desired sequence. This is because, as is clearly seen from the above explanation, by adopting the method of the present invention the automatic pouring equipment can continuously pour the molten metal, disregarding the results of measurements obtained by the means to measure the weight, when an acceleration force works on the ladle, and thus the operation is not affected by the additional force caused by the acceleration of the ladle. The method comprises pouring the molten metal in the mold from the ladle by a continuous driving of the three servomotors by the instructions given by the PLC, at the same time measuring the weight of the automatic pouring equipment, including the weight of the three servomotors, by the means to measure the weight, and calculating the change of the weight of molten metal in the ladle by the PLC.

The wording "when an acceleration force works on the ladle" means the total of the period of time (a) wherein the servomotors generate accelerations when the ladle starts tilting in the positive direction or when the instructions to drive the servomotors are changed based on the results of the measurement by the means to measure the weight and (b) the delay in the response of a load cell amplifier.

DETAILED DESCRIPTION OF THE INVENTION

Example 1

One embodiment of the automatic pouring equipment of the present invention is explained below in detail based on the drawings.

Figure 1:
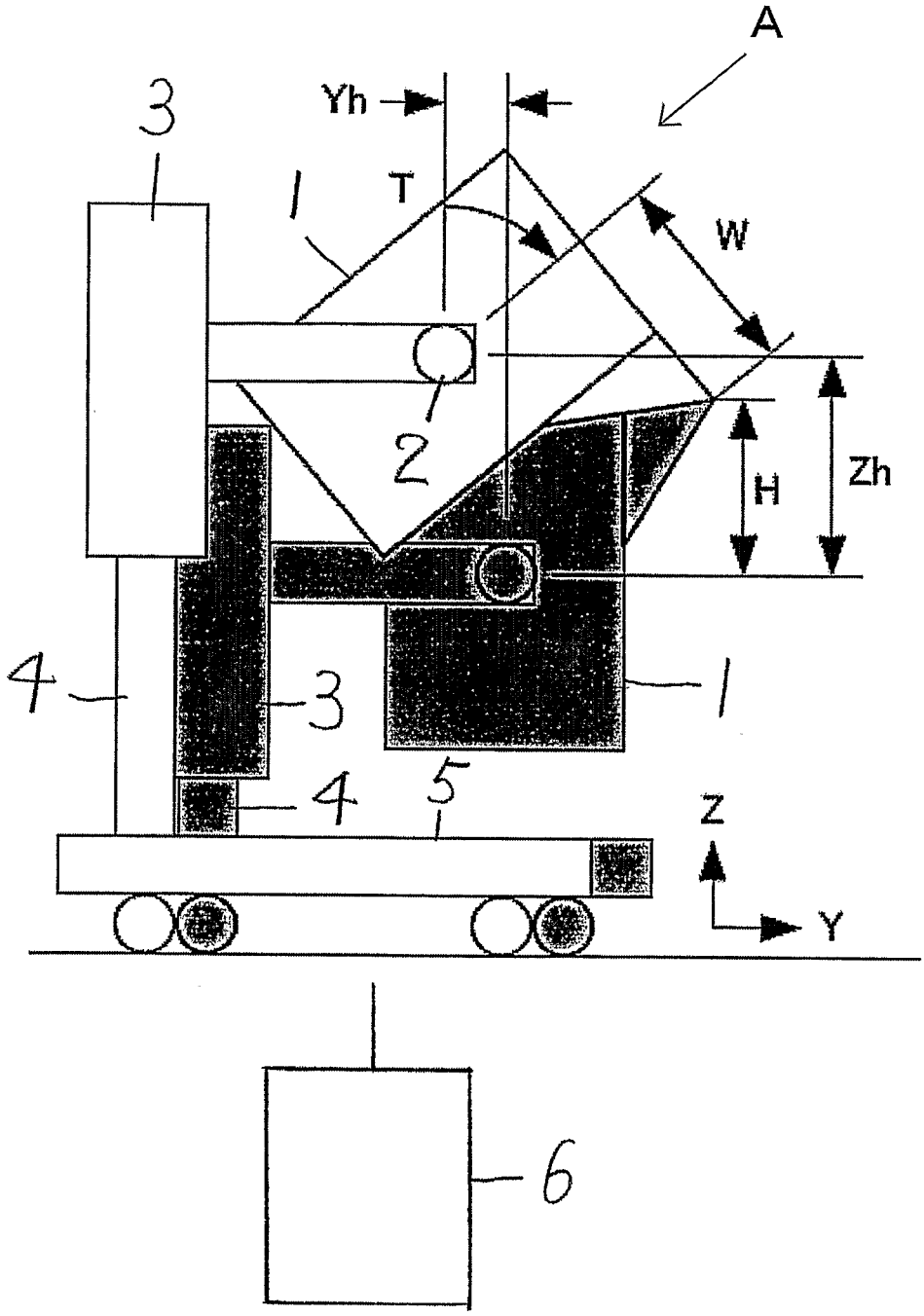
FIG. 1 is an outline drawing of one embodiment of the automatic pouring equipment of the present invention.

As shown in FIG. 1, the automatic pouring equipment A of the present invention comprises:

a ladle 1;

a supporting shaft 2 that supports the ladle at its center of gravity;

a first servomotor (not shown) with a decelerator, which servomotor gives torque to this supporting shaft 2 via a chain wheel and a roller chain;

a lifting frame 3, which is T-shaped in the lateral direction and which has the supporting shaft 2 at its end;

a vehicle 5 that carries the lifting frame 3, which frame 3 is movable upward and downward via a supporting pillar 4;

a ball screw mechanism (not shown) attached to the lifting frame 3, which mechanism lifts and lowers the lifting frame 3;

a second servomotor (not shown) connected to a threaded screw bar of the ball screw mechanism via a transmission means consisting of two belt pulleys and belts;

a rack-and-pinion mechanism (not shown) provided for the vehicle 5 and on the floor, which mechanism moves the vehicle 5 by turning the pinion of the vehicle 5 in the positive and reverse directions;

a third servomotor (not shown), with a decelerator, which servomotor turns the pinion in the positive and reverse directions;

a first means of recording that records the sequence of the operation of pouring by the ladle 1 that is operated by a continuous driving of the three servomotors under a PLC control;

a load cell (not shown) as a means of measuring a weight that measures, under the PLC control, the weight of the automatic pouring equipment, including the weight of the three servomotors;

a calculating means that calculates the instructions given to the three servomotors, under the PLC control, based on the measurement obtained by the load cell, and that transmits them to the three servomotors; and a second means of recording that records the length of time which the load cell measures and that should be disregarded, and that is calculated, under the PLC control, based on the data recorded in the first means of recording and the result of the calculation obtained by the calculating means.

The first means of recording, the calculating means, and the second means of recording are provided within the PLC (Programmable Logic Controller) 6. The value given by the load cell is adjusted so that it reflects only the weight of the molten metal in the ladle, with the weight of the ladle and the total weight of the tilting equipment being previously subtracted.

Figure 2:
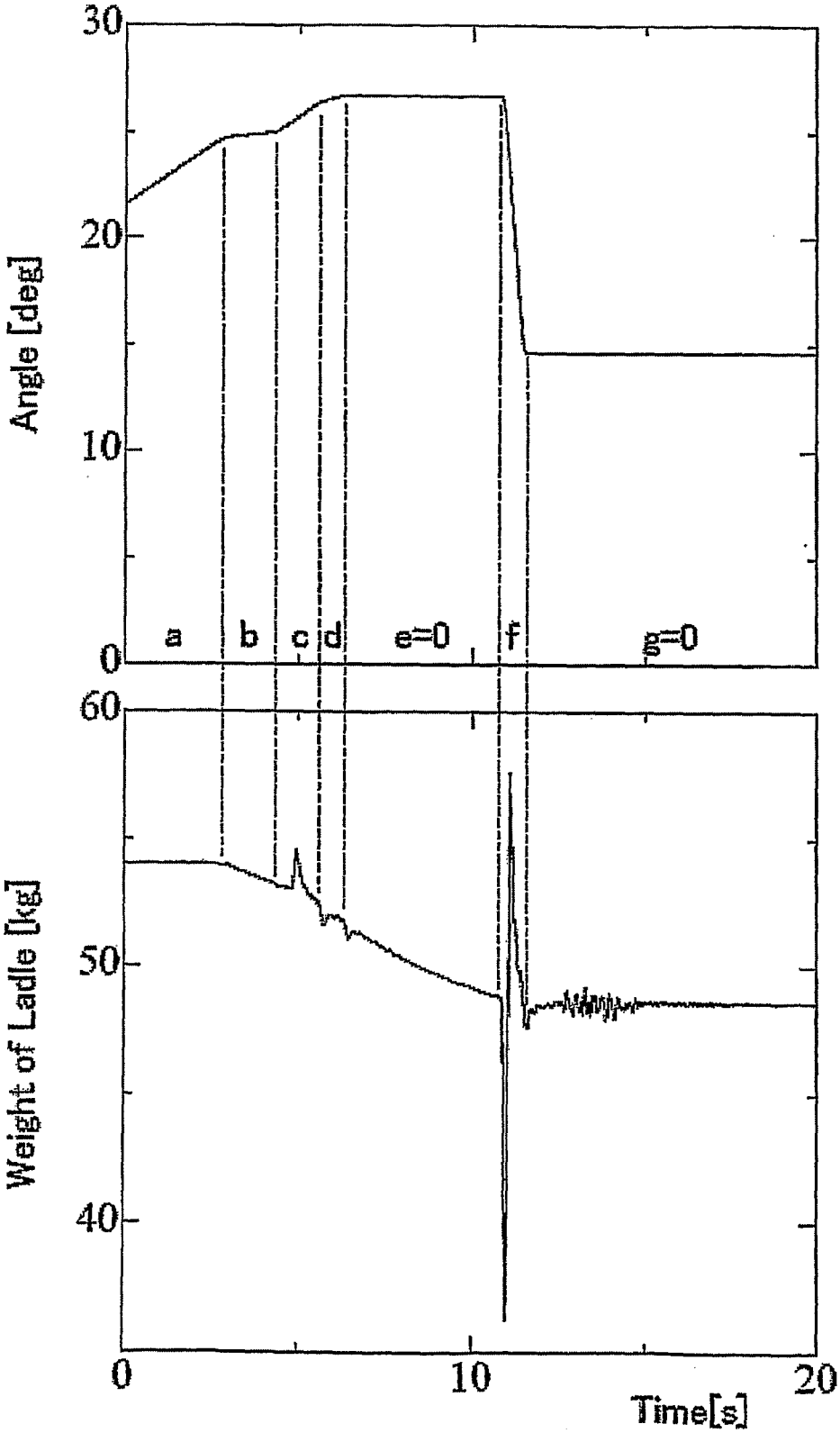
FIG. 2 shows the results of the pouring experiment using the automatic pouring equipment of FIG. 1.

The experiment of pouring the molten metal was carried out using the automatic pouring equipment thus constituted. Namely, the pouring operation was carried out in the sequence wherein the automatic pouring equipment was driven by the three servomotors, which were each controlled by the PLC, and the ladle was tilted, lifted and lowered, and moved forward and backward relative to the mold. FIG. 2 shows in graphs the results of the experiment.

The upper graph shows the angle of the tilting of the ladle, and the lower graph shows the value of the molten metal given by the load cell.

As seen from the graphs in FIG. 2, in Section "a," which corresponds to "before the start of pouring," there is no change of the weight in the ladle. Section "a" shows the constant weight of 54.05 kg of the molten metal in the ladle. In Section "b," which corresponds to "detecting after the start of pouring," the angular speed of tilting of the ladle 1 decreases and the change of the weight becomes moderate. After the weight reaches the predetermined level, the speed in "b" has changed to that in "c". But the load cell registers no serious effects because there is little difference in speed between "b" and "c."

However, section "c" shows a sharp fluctuation of the weight in the middle. Before this fluctuation occurs, the upward and downward movement in the direction of the Z-axis of the ladle is restrained so as to prevent the pouring from the higher position. However, the height of the tip of the nozzle has become sufficiently low, such that the adjustment in the upward and downward movement of the ladle has begun. Thus apparently the acceleration resulting from this upward and downward movement of the ladle has worked on the load cell. At one end of each of the sections "c" and "d," the speed has been reduced. When the speed of the upward and downward movement is reduced, the weight as measured by the load cell tends to show the value that is temporarily lower than the real weight. Thus, if judged based on the value of the weight thus obtained, the operation would produce an improper movement of the ladle. To prevent such an improper movement of the ladle, the automatic pouring equipment of the present invention adopts a method of disregarding the weight obtained by the load cell, which weight has been obtained within a certain length of time after the instructions to change the speed of the movement of the ladle are given. In the present experiment, this length of time is set at 0.7 second.

In section "e," to prevent mechanical noises from disturbing the measurement that is carried out by the load cell, the tilting of the ladle is stopped. When the weight reaches the predetermined value, the ladle starts a backward tilting movement and finally stops pouring. The load cell then registers a sharp acceleration because the ladle has started an abrupt backward tilting. Next, in section "g" the tilting stops, but there are some fluctuations in the weight. Although not shown in the graphs, they are due to the backward and forward movements in the Y-direction of the ladle 1 relative to the mold. The weight, after the fluctuations have subsided, is 48.59 kg, indicating the weight of the molten metal that has been poured is 5.46 kg.

In this experiment, the target weight of the molten metal that is to be poured is set at 5.48 kg. Thus the error rate is 0.36%. In the other experiments, carried out under different conditions, generally the error rate has not exceeded about 3%.

Further, by providing a third recording means in PLC 6, wherein the third means of recording records the weight of the molten metal when the ladle 1 temporarily stops pouring the molten metal before the ladle finally stops pouring, and wherein the third means of recording also records the weight of the molten metal when the ladle 1 starts a backward tilting movement, the pouring equipment can be temporarily stopped before the ladle finally stops pouring, so that neither the acceleration nor the mechanical noises of the motors affect the load cell.

This enables the automatic pouring equipment of the present invention to continuously carry out the pouring without the ladle being affected by an acceleration force that would work on the ladle or mechanical noises that would affect the load cell. Thus a precise quantity of molten metal can be poured into the mold.

Example 2

Another embodiment of the automatic pouring equipment of the present invention is explained in detail based on FIGS. 3-6.

Figure 3:
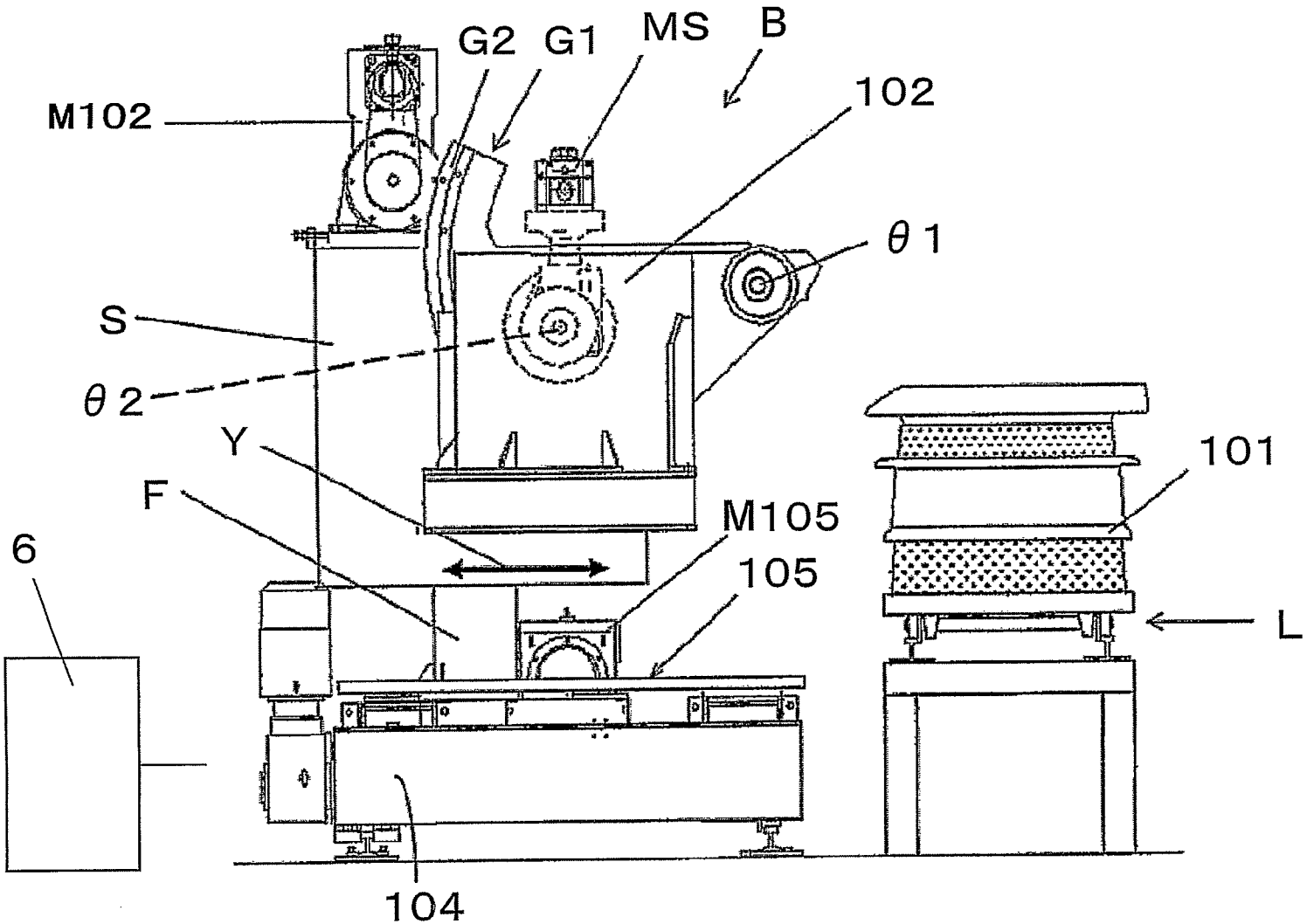
FIG. 3 is a front view of one embodiment of the automatic pouring equipment of the present invention.
Figure 4:
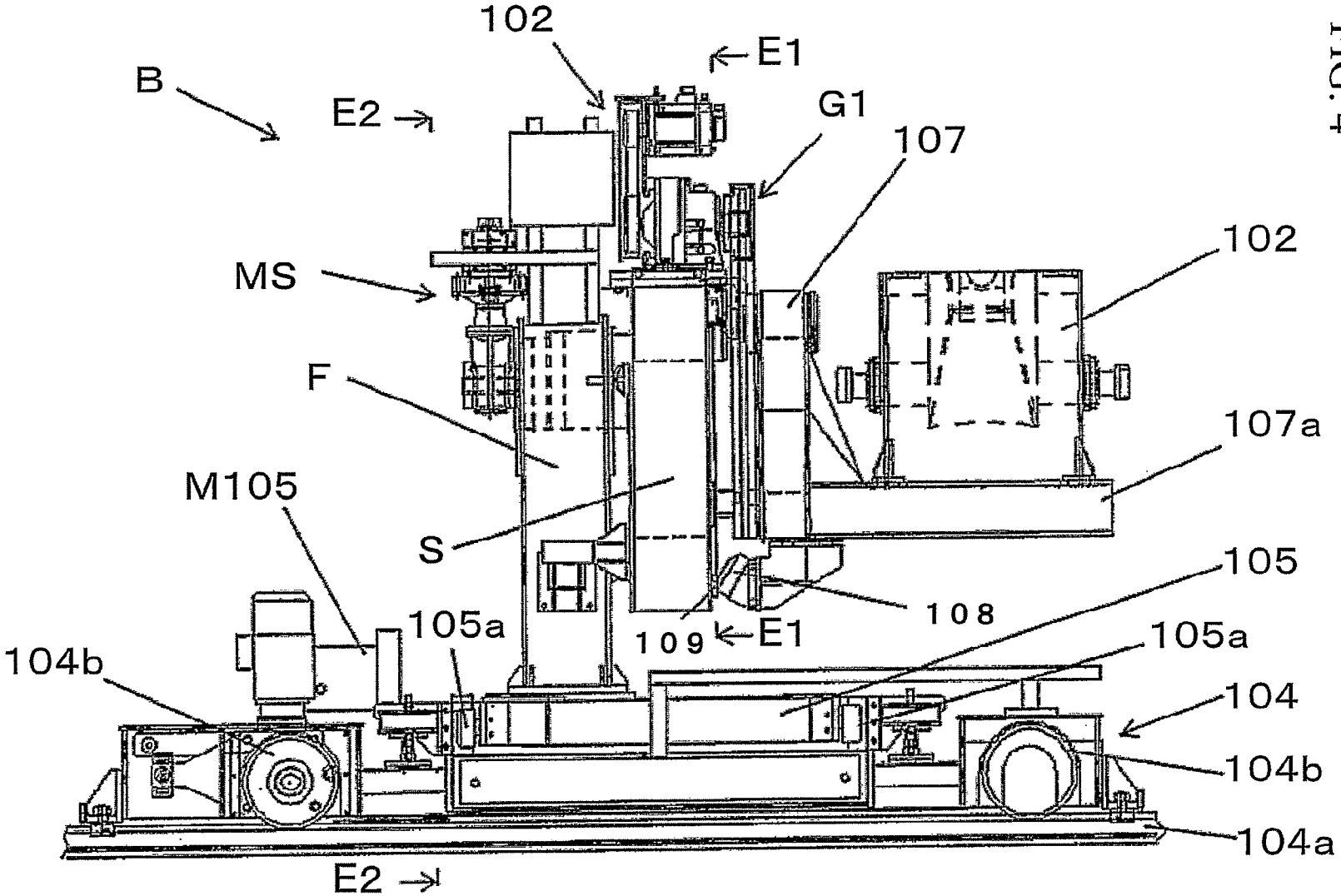
FIG. 4 is a side view of the automatic pouring equipment of FIG. 3.
Figure 5:
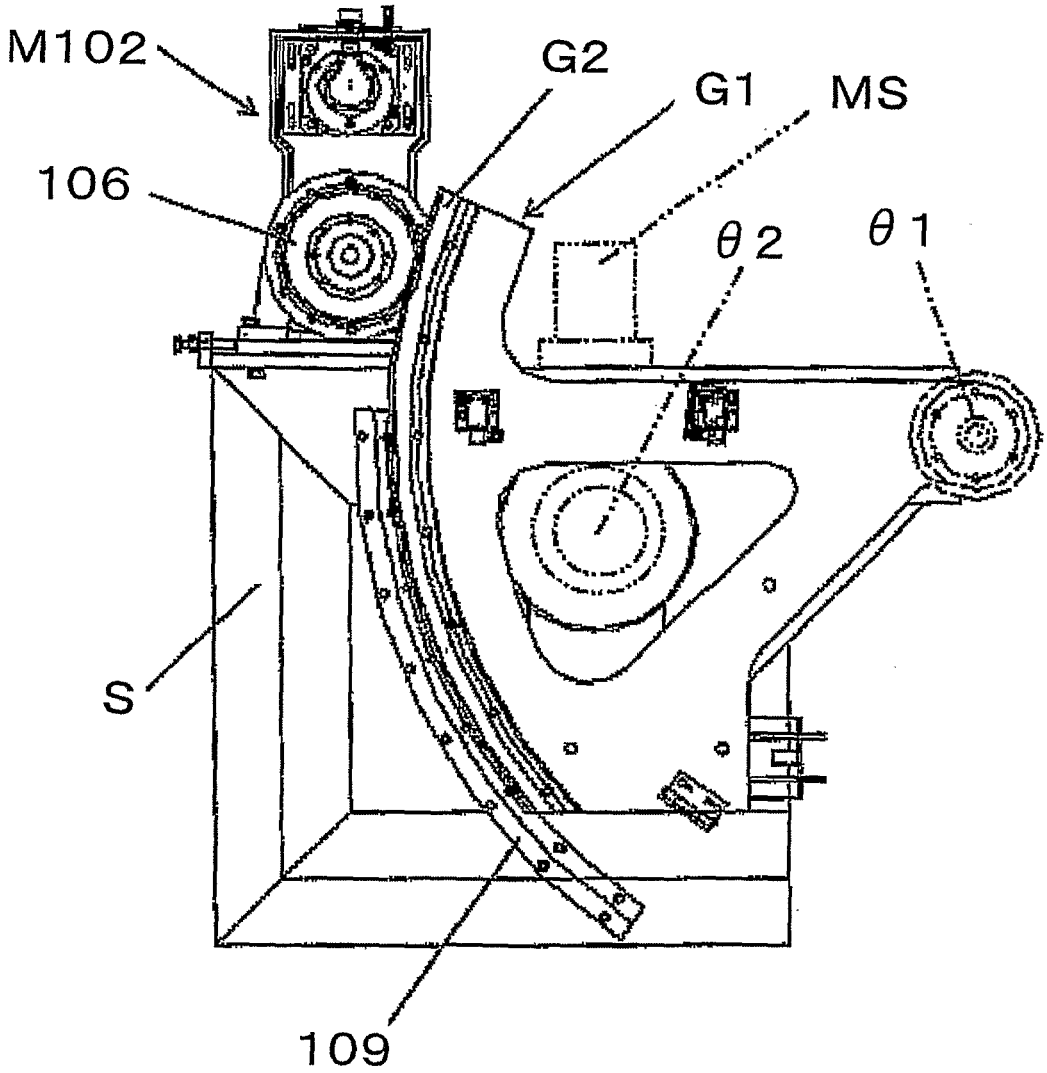
FIG. 5 is a cross sectional view of the automatic pouring equipment of FIG. 4 at line EI-EI.
Figure 6:
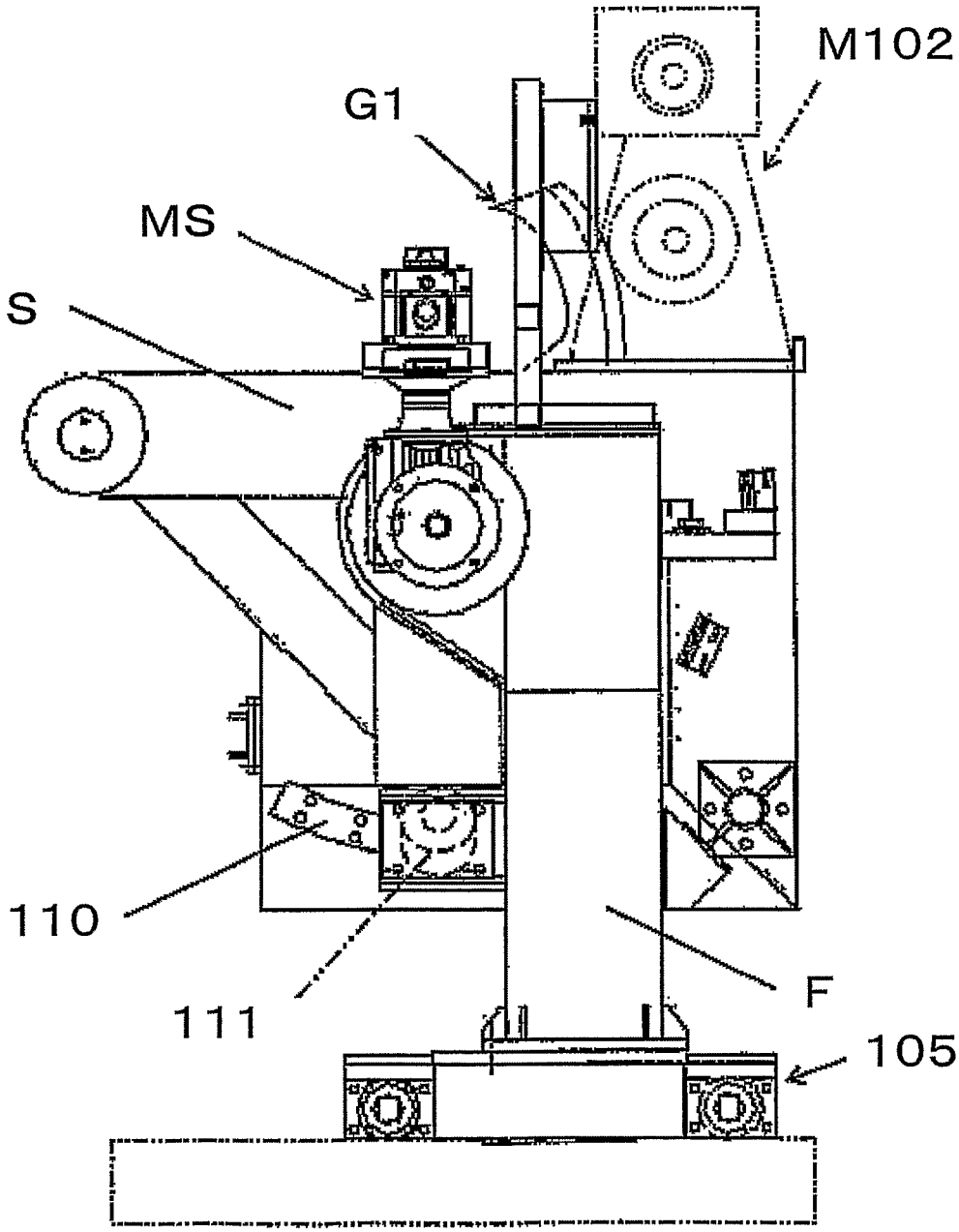
FIG. 6 is a cross sectional view of the automatic pouring equipment of FIG. 4 at line E2-E2.

FIG. 3 shows the automatic pouring equipment B, having a first rotating axis θ1 (in Example 2, near the end of the outflow position of the ladle), and a second rotating axis θ2 (in Example 2, near the center of gravity of the ladle), which pours the molten metal into the mold from the ladle 102 that moves along the Y-axis.

Molds 101 are laid in line on the molding line L. The molds 101 are intermittently moved. The ladle 102 pours the molten metal into the molds 101. The automatic pouring equipment B is used for this pouring.

The automatic pouring equipment B comprises:

a lower vehicle 104, mounted on a pair of rails 104*a*, and movable by means of wheels 104*b* on the rails that are laid along the molding line L;

an upper vehicle 105, mounted on the lower vehicle 104, and movable backward and forward by means of a roller 105*a* in the direction (Y-axis) that is perpendicular to the molding line L;

a fixed frame F, placed upright on the upper vehicle 105;

a tilting frame S, axially supported by the fixed frame F; and a means to support the ladle 102, the means to support the ladle 102 being axially supported by the tilting frame S.

The movement (Y-direction) of the upper vehicle 105, the tilting of the tilting frame S, and the tilting of the ladle 102, are all driven respectively by the servomotor M105 for the backward and forward movement, the servomotor MS for the tilting movement of the tilting frame S, and the servomotor M102 for the tilting movement of the ladle 102.

The ladle 102, which is placed on the horizontal member 107*a* of an L-shaped arm 107, is designed to tilt around the first rotating axis θ1 together with a sector frame G1 and the arm 107, wherein the tilting is driven by the servomotor MI02 by means of a fan-shaped sector frame G1, which frame is a means to support the ladle 102 and which frame is axially supported by the tilting frame S, the L-shaped arm 107 attached to the side of the sector frame G1, and a sector gear G2 that engages with the driving gear 106 of the servomotor MI 02. The arm 107, having a wheel 108 under it, has the wheel 108 supported by a shaft. The wheel 108, which is inclined, is also supported by a liner 109, which is attached to the side of the tilting frame S. This liner 109 is provided at least in the area where the sector frame G1 tilts. Also, a liner 110, disposed at the back of the tilting frame S, is provided at least in the area where the tilting frame S tilts. The tilting frame S is supported by a wheel 111, which is axially supported by the frame F.

The automatic pouring equipment is constituted in a way such that the tilting frame S, which is axially supported by the fixed frame F, itself tilts around the second rotating axis θ2 by means of a driving motor MS. Thus the ladle 102 can tilt not only around the first rotating axis θ1, but also around the second rotating axis θ2, which is a rotating axis different from the first rotating axis θ1. This makes it possible, during the pouring of the molten metal, to adjust the angle of the tilting of the ladle around the first rotating axis θ1 and the second rotating axis θ2, and to adjust the position of the ladle in the movement along the Y-axis that is perpendicular to the molding line L on the horizontal plane, by tilting the ladle around the first rotating axis θ1 and around the second rotating axis θ2.

The three servomotors, i.e., the servomotor M105 for the backward and forward movement, the servomotor MS for tilting the tilting frame, and the servomotor M102 for tilting the ladle, which servomotors drive the ladle relative to the mold, correspond to the three servomotors of Example 1. Also, a first means of recording, a means of measuring a weight, a calculating means, a second means of recording, a third means of recording, to control by PLC, etc., are the same as described in Example 1.

The present invention will become more fully understood from the detailed description of this specification. However, the detailed description and the specific embodiment illustrate desired embodiments of the present invention and are described only for the purpose of explanation. Various possible changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not limit the scope of the invention unless otherwise claimed.

The invention claimed is:

1. A method to control automatic pouring equipment for pouring molten metal by three servomotors that are each driven and controlled by a PLC and that act to have a ladle tilted, lifted, and moved backward and forward relative to a mold, the method comprising pouring molten metal into a mold from a ladle that is operated by a continuous driving of the three servomotors by instructions given by the PLC, at the same time measuring a weight of the automatic pouring equipment, including a weight of the three servomotors by a means to measure the weight, and calculating a change of the weight of molten metal in the ladle by the PLC, wherein during the pouring of the molten metal, disregarding results of measurements obtained by the means to measure the weight of the automatic pouring equipment, including the weight of the three servomotors, when an acceleration force works on the ladle.

2. A method to control automatic pouring equipment for pouring molten metal by three servomotors that are each driven and controlled by a PLC and that act to have a ladle tilted, lifted, and moved backward and forward, so as to pour a precise quantity of the molten metal in the mold, the method comprising pouring molten metal into a mold from a ladle that is operated by a continuous driving of the three servomotors under instructions given by the PLC by tilting the ladle forward, at the same time measuring a weight of the automatic pouring equipment, including a weight of the three servomotors, by a means to measure the weight, calculating the change of the weight of the molten metal in the ladle by the PLC, and allowing the ladle to temporarily stop tilting forward, but wherein the molten metal still continues to flow from the ladle into said mold and wherein when the weight of the automatic pouring equipment, including the weight of the three servomotors measured by the means to measure the weight reaches a predetermined value, the ladle starts a backward tilting movement and finally stops pouring the molten metal into said mold.

3. The method to control the automatic pouring equipment of claim 1, wherein "when an acceleration force works on the ladle" means the total of a period of time (a) wherein the three servomotors generate accelerations when the ladle starts tilting forward or when the instructions to drive the servomotors are changed based on the results of the measurement by the means to measure the weight and (b) the delay in response of a load cell amplifier.

4. A method to control automatic pouring equipment for pouring molten metal by three servomotors that are each driven and controlled by a PLC and that act to have a ladle tilted by a first tilting movement and second tilting movement and moved backward and forward relative to a mold, the method comprising pouring molten metal into a mold from a ladle by a continuous driving of the three servomotors under instructions given by the PLC that tilt the ladle with a first tilting movement and a second tilting movement, at the same time measuring a weight of the automatic pouring equipment, including the weight of the three servomotors by a means to measure the weight, and calculating a change of the weight of the molten metal in the ladle by the PLC, wherein during the pouring of the molten metal, disregarding results of measurements obtained by the means to measure the weight of the automatic pouring equipment, including the weight of the three servomotors, when an acceleration force works on the ladle.

5. A method to control automatic pouring equipment for pouring molten metal by three servomotors that are each driven and controlled by a PLC and that act to have a ladle tilted by a first tilting movement and a second tilting movement and moved backward and forward, so as to pour a precise quantity of the molten metal in the mold, the method comprising pouring molten metal into a mold from a ladle by a continuous driving of the three servomotors under instructions given by the PLC that tilt the ladle forward with a first tilting movement and a second tilting movement, at the same time measuring a weight of the automatic pouring equipment, including a weight of the three servomotors, by a means to measure the weight, calculating the change of the weight of the molten metal in the ladle by the PLC, and allowing the ladle to temporarily stop tilting forward, but wherein the molten metal still continues to flow from the ladle into said mold and wherein when the weight of the automatic pouring equipment, including the weight of the three servomotors measured by the means to measure the weight reaches a predetermined value, the ladle starts a backward tilting movement and stops pouring the molten metal into said mold.

6. The method to control the automatic pouring equipment of claim 4, wherein "when an acceleration force works on the ladle" means the total of a period of time (a) wherein the three servomotors generate accelerations when the ladle starts tilting forward or when the instructions to drive the servomotors are changed based on the results of the measurement by the means to measure the weight and (b) the delay in response of a load cell amplifier.

* * * * *